US010287725B2

(12) United States Patent
Tan et al.

(10) Patent No.: US 10,287,725 B2
(45) Date of Patent: May 14, 2019

(54) STEAM DEVICE

(71) Applicant: KONINKLIJKE PHILIPS N.V., Eindhoven (NL)

(72) Inventors: Boon Teck Tan, Eindhoven (NL); Hee Keng Chua, Eindhoven (NL); Chen-Shiang Lee, Eindhoven (NL); Mohankumar Valiyambath Krishnan, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/511,283

(22) PCT Filed: Sep. 9, 2015

(86) PCT No.: PCT/EP2015/070549
§ 371 (c)(1),
(2) Date: Mar. 15, 2017

(87) PCT Pub. No.: WO2016/041820
PCT Pub. Date: Mar. 24, 2016

(65) Prior Publication Data

US 2017/0260684 A1 Sep. 14, 2017

(30) Foreign Application Priority Data

Sep. 17, 2014 (EP) ..... 14185071

(51) Int. Cl.
*D06F 75/20* (2006.01)
*D06F 75/18* (2006.01)
*D06F 75/24* (2006.01)

(52) U.S. Cl.
CPC ..... *D06F 75/20* (2013.01); *D06F 75/18* (2013.01); *D06F 75/24* (2013.01)

(58) Field of Classification Search
CPC ..... D06F 75/00; D06F 75/24; D06F 75/38
See application file for complete search history.

(56) References Cited

U.S. PATENT DOCUMENTS 1,969,583 A 8/1934 Skolnik
2,637,126 A * 5/1953 Fitzsimmons ..... D06F 75/18 38/77.83

(Continued)

FOREIGN PATENT DOCUMENTS

CN 201016147 Y 2/2008
CN 103820987 A 5/2014

(Continued)

*Primary Examiner* — Ismael Izaguirre

(57) ABSTRACT

The present application relates to a steam device comprising a steam chamber having a steam generating surface onto which liquid water is provided to be evaporated into steam, a fabric treating plate comprising a fabric treating face and at least one steam vent through which steam is expelled onto a fabric to be steamed, an outlet flow section located between the steam generating surface and the fabric treating face wherein the outlet flow section defines an indirect flow path between the steam chamber and the at least one steam vent and a heater for heating the outlet flow section such that liquid water which enters the outlet flow section from the steam chamber is evaporated into steam. The outlet flow section comprises at least one boundary surface with a plurality of recesses for reducing the flow rate of liquid water travelling through the outlet flow section.

15 Claims, 6 Drawing Sheets

(56) References Cited

U.S. PATENT DOCUMENTS

| | | | | | |
|---|---|---|---|---|---|
| 2,652,645 | A * | 9/1953 | Youhouse | D06F 75/16 | 38/77.8 |
| 2,744,342 | A * | 5/1956 | More | D06F 75/18 | 38/77.83 |
| 3,103,079 | A * | 9/1963 | Bricker | D06F 75/18 | 38/77.81 |
| 3,110,975 | A * | 11/1963 | Kircher | D06F 75/18 | 38/77.7 |
| 3,811,208 | A * | 5/1974 | Vieceli | D06F 75/14 | 38/77.8 |
| 4,077,143 | A * | 3/1978 | Walker | D06F 75/18 | 38/77.83 |
| 7,305,780 | B2 * | 12/2007 | Lukas | D06F 75/20 | 38/93 |
| 2003/0121900 | A1 * | 7/2003 | Wang | D06F 75/18 | 219/251 |
| 2006/0179692 | A1 * | 8/2006 | Lin | D06F 75/10 | 38/89 |
| 2006/0210784 | A1 * | 9/2006 | Shi | B05D 5/04 | 428/304.4 |
| 2010/0242316 | A1 * | 9/2010 | Wielstra | D06F 75/18 | 38/77.83 |

FOREIGN PATENT DOCUMENTS

| | | | |
|---|---|---|---|
| FR | 2917429 | A3 | 12/2008 |
| WO | 2005118944 | A1 | 12/2005 |
| WO | 2009044320 | A2 | 4/2009 |
| WO | 2014106793 | A1 | 7/2014 |

* cited by examiner

STEAM DEVICE

This application is the U.S. National Phase application under 35 U.S.C. § 371 of International Application No. PCT/EP2015/070549, filed on Sep. 9, 2015, which claims the benefit of International Application No. 14185071.9 filed on Sep. 17, 2014. These applications are hereby incorporated by reference herein.

FIELD OF THE INVENTION

The present invention relates to a steam device.

BACKGROUND OF THE INVENTION

A conventional steam iron typically comprises a steam chamber and an ironing plate. The steam chamber comprises a heated plate onto which liquid water is supplied to be evaporated into steam. The steam chamber is fluidly communicated with a plurality of steam vents in the ironing plate such that steam generated in the steam chamber is expelled from the steam vents and onto a fabric to be steamed.

Liquid water may accumulate in the steam chamber when liquid water is supplied to the heated plate at a high flow rate, for example to generate a large amount of steam, and may subsequently flow from the steam chamber and out of the steam vents onto the fabric to be steamed. To prevent the liquid water being expelled from the steam vents, it is known to increase the size of the heated plate such that more of the liquid water in the steam chamber contacts the heated plate and is evaporated in the steam chamber. However, increasing the size of the heated plate increases the size and weight of the steam iron such that the steam iron is cumbersome to manoeuvre and difficult to store.

FR 2,917,429 discloses a steam iron with a heating member that defines a steam chamber. The steam chamber includes a heat conducting structure for improving steam output. The heating member and a bottom plate of the steam iron constitute another steam chamber.

WO 2014/106793 discloses a garment steaming device with a steam generator having a heater and an ironing surface against which a fabric of a garment is locatable. An intermediate section is disposed between the steam generator and the ironing surface to transfer heat from the steam generator to the ironing surface so that the ironing surface is indirectly heated by the steam generator via the intermediate section.

OBJECT AND SUMMARY OF THE INVENTION

It is an object of the invention to provide a steam device and a steam iron which substantially alleviates or overcomes the problems mentioned above.

The object of the present invention is solved by the subject-matter of the independent claims, wherein further embodiments are incorporated in the dependent claims.

According to the present invention, there is provided a steam device comprising: a steam chamber having a steam generating surface onto which liquid water is provided to be evaporated into steam; a fabric treating plate comprising a fabric treating face and at least one steam vent through which steam is expelled onto a fabric to be steamed; an outlet flow section which is located between the steam generating surface and the fabric treating face and defines an indirect flow path between the steam chamber and the at least one steam vent; and, a heater that is configured to heat the outlet flow section such that liquid water which enters the outlet flow section from the steam chamber is evaporated into steam. The outlet flow section comprises at least one boundary surface with a plurality of recesses for reducing the flow rate of liquid water travelling through the outlet flow section.

Since steam and liquid water exiting the steam chamber outlet must flow in an indirect path, the time taken for the steam and liquid water to travel from the steam chamber to the at least one steam vent is increased in comparison to if the steam and liquid water were able to follow a direct linear path. Therefore, liquid water that flows into the outlet flow section from the steam chamber is subjected to the heat from the heater for a longer period of time and so more of the liquid water in the outlet flow section is evaporated into steam than if the liquid water was able to flow directly from the steam chamber to the at least one steam vent. Thus, the steam device is able to generate more steam than a conventional steam device that has a similarly sized steam generating surface but does not include an indirect flow path between the steam chamber and the at least one steam vent.

In addition, since the outlet flow section is located between the steam generating surface and the fabric treating face, the heater is able to heat both of the steam generating surface and the outlet flow section simultaneously and the steam device can be made more compact.

The outlet flow section may comprise a labyrinth configuration. Steam flowing through the labyrinth configuration must change direction, which helps to cause a collision of the steam with surfaces of the outlet flow section such that relatively heavy larger water droplets are removed from the steam and therefore the larger water droplets are prevented from being expelled onto the fabric to be steamed. In addition, the labyrinth configuration increases the time it takes for liquid water to flow from the steam chamber to the at least one steam vent and so increases the amount of the liquid water that is evaporated into steam such that less liquid water is expelled onto the fabric to be steamed.

In one embodiment, the outlet flow section comprises a serpentine channel that defines the flow path. The serpentine channel increases the length of the flow path for a given size of outlet flow section and therefore increases the time taken for the steam and liquid water to travel from the steam chamber to the at least one steam vent.

In one embodiment, the outlet flow section comprises at least one baffle configured to change the direction of fluid flowing in the outlet flow section. The steam device may comprise a steam generating plate that comprises the steam generating surface. The outlet flow section may be located between the steam generating plate and the fabric treating plate. The steam generating plate and the fabric treating plate may be substantially parallel. The at least one baffle may extend from the steam generating plate. The at least one baffle extending from the steam generating plate helps to maximise conduction to the at least one baffle from the heater if the heater is configured to heat the steam generating plate. This helps to increase the temperature of the at least one baffle such that liquid water than contacts the at least one baffle is more quickly evaporated into steam. In one embodiment, the at least one baffle extends from the opposite side of the steam generating plate to the steam generating surface.

In one embodiment, the outlet flow section is configured such that the flow path comprises a first portion that extends in a first direction and a second portion that extends in a second direction, opposite to the first direction. This increases the length of the flow path and so increases the time taken for the steam and liquid water to travel from the steam chamber to the at least one steam vent.

In one embodiment, the outlet flow section is configured such that at least part of the flow path follows a wavy path to induce a direction change of fluid flowing along the flow path. This causes relatively heavy larger water droplets to contact surfaces of the outlet flow section such that the larger water droplets are removed from the steam.

The heater may be configured to heat the steam generating surface. The heater may be configured to maintain the steam generating surface and the outlet flow section at a temperature of at least 100 degrees Celsius during operation of the steam device. The heater being configured to heat both the steam generating surface and the outlet flow section makes the steam device more efficient than if separate heaters are used, and reduces the cost of manufacturing the steam device.

In one embodiment, the outlet flow section comprises a coating that is configured to promote the evaporation of liquid water into steam in the outlet flow section. The coating may be configured to cause liquid water in the outlet flow section to spread out on the surfaces of the outlet flow section such that the liquid water is evaporated more efficiently. The coating may be configured to act as an insulator to prevent the liquid water being heated too quickly by the heater such that the Leidenfrost effect is alleviated. The insulating properties of the coating are determined by the thickness and thermal conductivity of the material of the coating. For example, increasing the thickness or decreasing the thermal conductivity of the material of the coating increases the insulating properties of the coating and therefore decreases the Leidenfrost effect. Furthermore, if the coating is porous then the porosity of the coating affects the insulating properties of the coating. The coating may comprise, for instance, a colloidal steam promoter. Alternatively, or additionally, the heater may be configured such that the outlet flow section is not heated above a certain temperature, for example 170 degrees Celsius, such that the Leidenfrost affect is alleviated.

In one embodiment, the outlet flow section comprises a porous layer that is configured to absorb liquid water in the outlet flow section. Therefore, the liquid water takes longer to travel through the outlet flow section from the steam chamber to the at least one steam vent and so the liquid water is subjected to the heat form the heater for a longer period of time such that more of the liquid water is evaporated into steam. Furthermore, the porous layer increases the surface area of the outlet flow section and so increases the heat transfer from the heater to the liquid water. In one embodiment, the thickness of the porous layer is less than 0.2 mm.

At least one boundary surface of the outlet flow section may comprise a plurality of protrusions. The protrusions increase the surface area of the outlet flow section and/or slow the liquid water as it travels through the outlet flow section such that more of the liquid water is evaporated into steam.

In one embodiment, the height of the outlet flow section is no greater than 5 mm. This helps to ensure that liquid water in the outlet flow section contacts opposing surfaces of the outlet flow section such that the liquid water can be more effectively evaporated into steam. In addition, if the liquid water contacts both of said opposing surfaces then if one of said surfaces comprises a coating that is configured to spread the liquid water out over said surface then the liquid water will also be spread out over the other one of said surfaces. The height of the outlet flow section may be defined as the dimension of the flow path in the direction between the fabric treating face and the steam generating surface. In one embodiment, the height of the outlet flow section is no greater than 3 mm.

The steam device may be in the form of a steam iron. The steam device may be a hand-held steam device.

These and other aspects of the invention will be apparent from and elucidated with reference to the embodiments described hereinafter.

BRIEF DESCRIPTION OF THE DRAWINGS

Embodiments of the invention will now be described, by way of example only, with reference to FIGS. 7 and 8 of the accompanying drawings, in which.

DETAILED DESCRIPTION OF THE EMBODIMENTS

Figure 1:
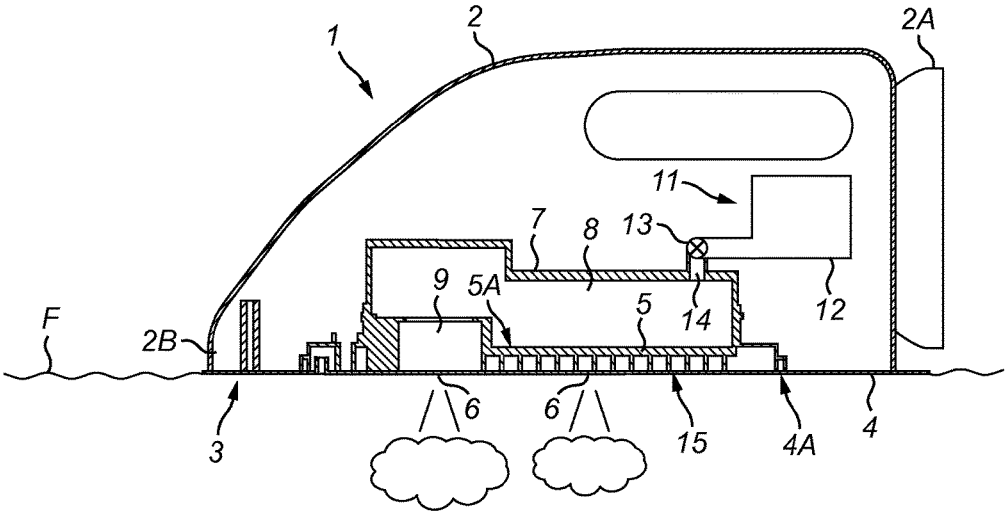
FIG. 1 is a schematic cross-sectional side view of a steam iron that is shown for information purposes.
Figure 2:
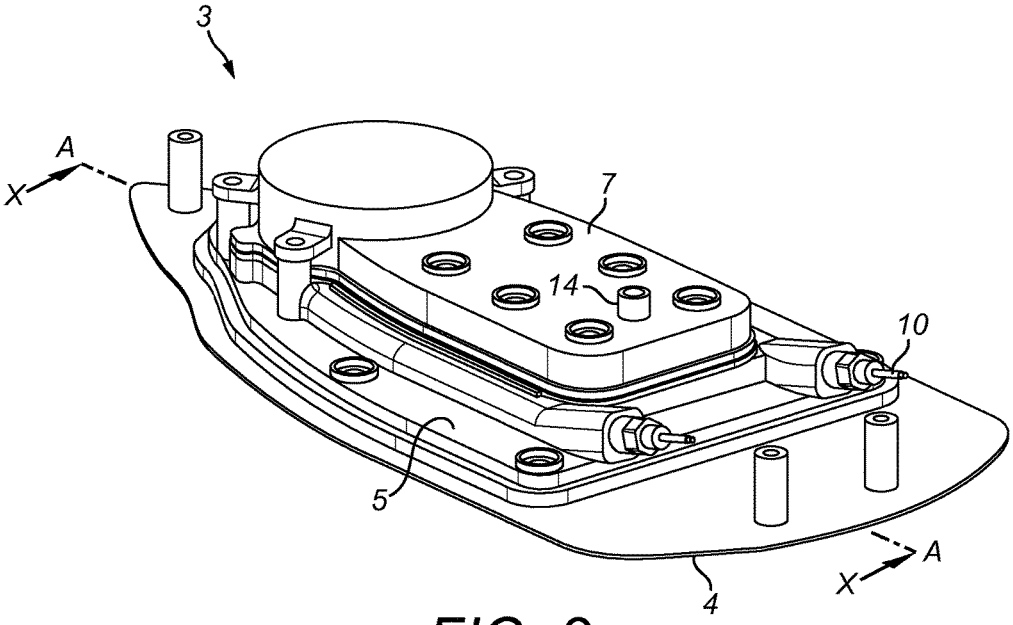
FIG. 2 is a perspective view of a soleplate of the steam iron of FIG. 1.
Figure 3:
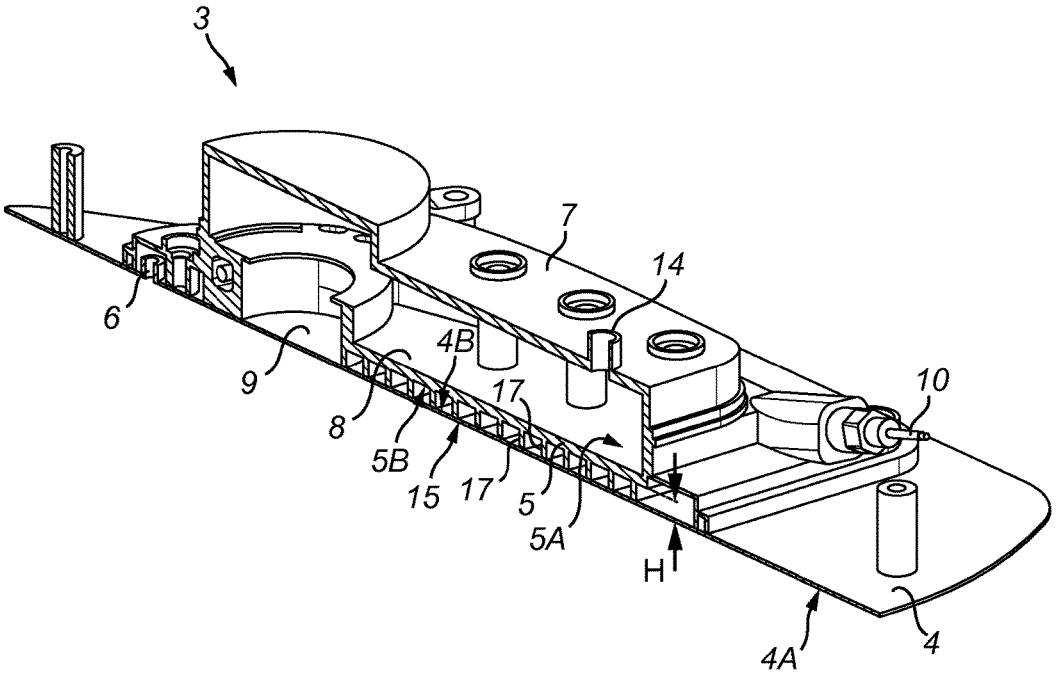
FIG. 3 is a cross-sectional perspective view of the soleplate of FIG. 2, viewed along the longitudinal axis A-A of the soleplate in the direction of arrow X in FIG. 2.
Figure 4:
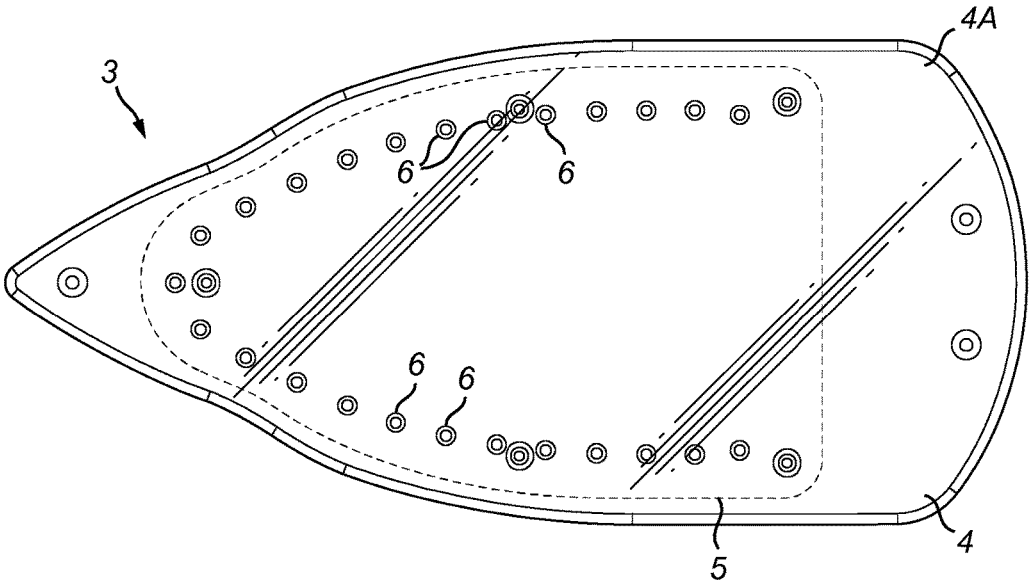
FIG. 4 is a bottom view of the soleplate of FIG. 2, showing the periphery of a steam generating plate as a chain-dashed line.

Referring to FIGS. 1 to 6, a steam device 1 is shown for background information. The steam device 1 is in the form of a steam iron 1. The steam iron 1 comprises a housing 2 and a soleplate 3.

The housing 2 comprises a heel 2A that is disposed at an end of the housing 2 distal to the tip 2B of the steam iron 1. When not in use, the steam iron 1 may be placed in a stable, non-ironing, upright position resting on its heel 2A so that the soleplate 3 is out of contact with any surfaces.

The soleplate 3 comprises a fabric treating plate 4 and a steam generating plate 5. A major surface of the fabric treating plate 4 comprises a fabric treating surface 4A which, during use, is located against a fabric F to be treated by steam. The steam generating plate 5 comprises a steam generating surface 5A that is parallel to the fabric treating face 4A of the fabric treating plate 4 and faces in the opposite direction thereto.

The fabric treating plate 4 comprises a plurality of steam vents 6. The steam vents 6 are located near to, but spaced from, the periphery of the steam generating plate 5. It will be understood that the number of steam vents 6 may vary. One steam vent may be present, or a plurality of steam vents 6 may be distributed along the fabric treating face 4A.

The soleplate 3 also comprises a cover 7. The cover 7 is mounted to the steam generating plate 5 and defines an upper end of the soleplate 3. It will be understood that the steam generating plate 5 and cover 7 may be integrally formed. A space is defined between the steam generating surface 5A and the cover 7 and comprises a steam chamber 8 having a steam chamber outlet 9 that is fluidly communicated with the steam vents 6.

A heater 10 is partially received in the steam generating plate 5 and protrudes from both sides of the steam generating plate 5. The heater 10 extends longitudinally along the steam generating plate 5 in the same direction as the longitudinal axis A-A of the soleplate 3, which extends in the direction from the heel 2A to the tip 2B of the steam iron 1. The heater 10 has a U-shaped arrangement with the apex of the heater 10 disposed distal to the heel 2A of the steam iron 1. The heater 10 extends partially around the periphery of the steam chamber 8 and is configured to conduct heat to the steam generating plate 5, when operated. It will be understood that the arrangement of the heater 10 may differ.

A water supply unit 11 is disposed inside the housing 2 of the steam iron 1. The water supply unit 11 comprises a water tank 12, a pump 13 and a water inlet 14. The pump 13 is configured to supply liquid water from the water tank 12 to the water inlet 14. The water inlet 14 is arranged to spray, drip or jet the liquid water supplied thereto onto the steam generating surface 5A such that the liquid water spreads over the steam generating surface 5A. Therefore, when the heater 10 is operated to heat the steam generating surface 5A, the liquid water on the steam generating surface 5A is evaporated into steam inside the steam chamber 8. The steam flows out of the steam chamber outlet 9 and then through the steam vents 6 to be expelled from the fabric treating face 4A. Therefore, fabric F located against the fabric treating face 4A will be treated by the steam.

The amount of steam that is expelled from the seam vents 6 and onto the fabric F to be steamed can be controlled by varying the amount of liquid water that is supplied to the steam chamber 8 by the water supply unit 11. More specifically, the speed of the pump 13 can be varied by a controller (not shown) to adjust the flow rate of the liquid water supplied to the steam generating surface 5A to control the flow rate of steam generated in the steam chamber 8.

It is sometimes necessary to operate the steam iron 1 in such a manner that a high flow rate of steam is expelled from the steam vents 6, for example if the steam iron 1 is used to remove stubborn creases or to remove creases from certain types of fabric that require a high flow rate of steam for effective crease removal. To generate a high flow rate of steam, the water supply unit 11 is operated to supply liquid water from the water tank 12 to the steam generating surface 5A at a high flow rate such that a large volume of steam is generated in the steam chamber 8.

It has been found that when liquid water is supplied to the steam generating surface 5A at a high flow rate to generate a large amount of steam, the liquid water can accumulate in the steam chamber 8 and flow out of the steam chamber outlet 9 to then be expelled from the steam vents 6. This can result in 'spitting' of hot water from the steam iron 1 which can burn the user and can cause wet patches to form on the fabric F being treated by steam.

To prevent liquid water from accumulating in the steam chamber 8 when liquid water is supplied to the steam generating surface 5A at a high flow rate by the water supply unit 11, it is known in the art to increase the surface area of the steam generating surface 5A such that more of the liquid water is in contact with the steam generating surface 5A to increase the rate at which liquid water is evaporated in the steam chamber 8. Therefore, since the evaporation rate of liquid water in the steam chamber 8 is increased, liquid water is prevented from accumulating in the steam chamber 8 and subsequently flowing out of the steam chamber outlet 9 and through the steam vents 6. However, it has been found that increasing the surface area of the steam generating surface 5A increases the weight of the steam iron 1 and increases the size of the housing 2 such that the steam iron 1 is cumbersome to manoeuvre and difficult to store. In addition, if the surface area of the steam generating surface 5A was increased then a larger heater 10 would be required to heat the steam chamber 8 and so the steam iron 1 would consume more electrical energy during use.

The steam iron 1 comprises an outlet flow section 15 that fluidly communicates the steam chamber outlet 9 with the steam vents 6. The outlet flow section 15 is located between the steam generating plate 4 and the fabric treating plate 5 and is configured such that fluid flows in a convoluted or indirect path from the steam chamber outlet 9 to the steam vents 6. Therefore, the time taken for steam and liquid water to travel from the steam chamber 8 to the steam vents 6 is increased in comparison to if the steam and liquid water were able to follow a direct linear path.

The fabric treating plate 4 comprises a major surface that faces in the opposite direction to the fabric treating face 4A and forms a first boundary surface 4B of the outlet flow section 15. The steam generating plate 5 comprises a major surface that faces in the opposite direction to the steam generating surface 5A and forms a second boundary surface 5B of the outlet flow section 15. The first and second boundary surfaces 4B, 5B are parallel and face towards each other.

Figure 5:
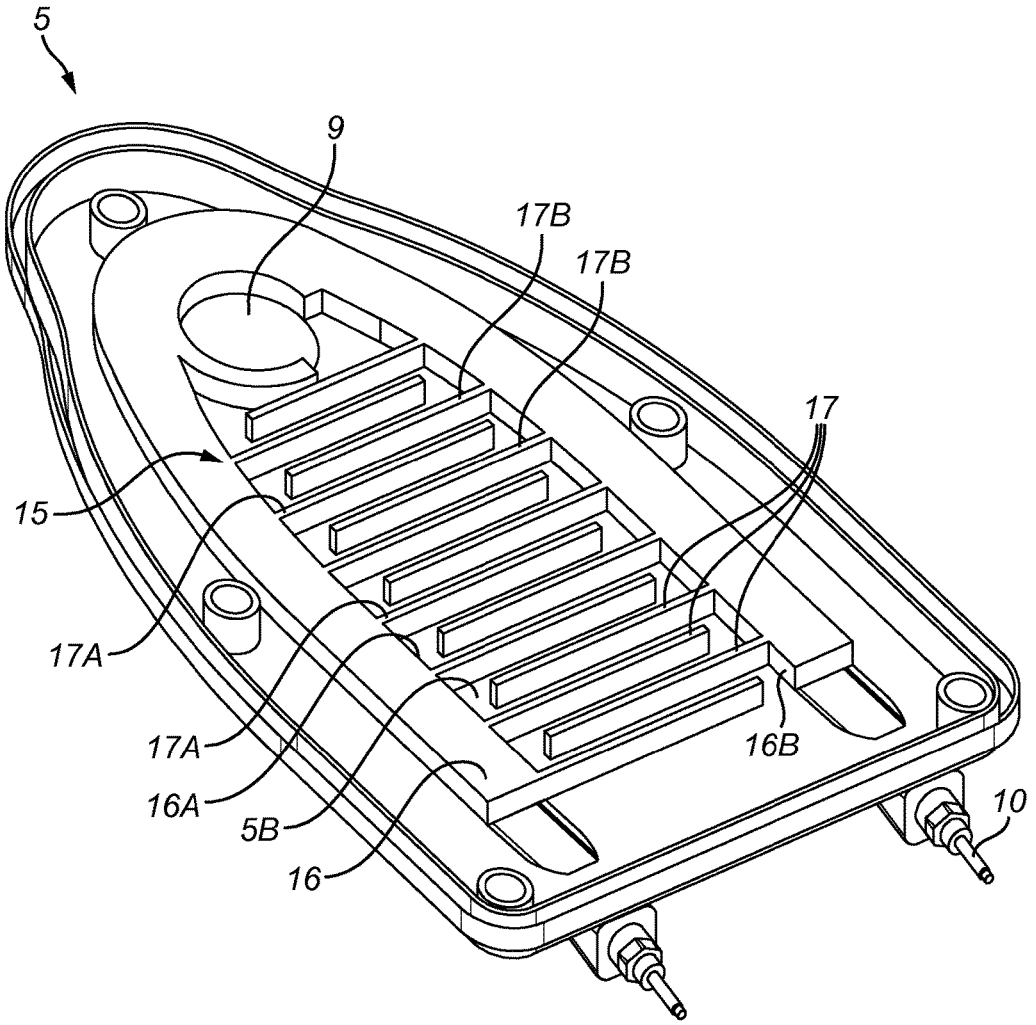
FIG. 5 is a perspective view from underneath of the steam generating plate of the soleplate of FIG. 2.
Figure 6:
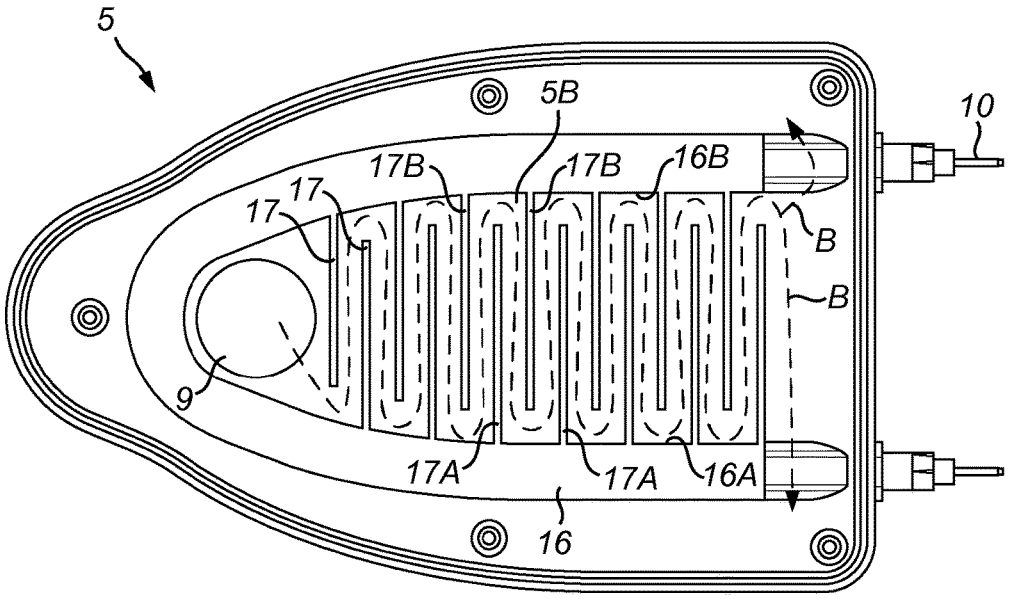
FIG. 6 is a bottom view of the steam generating plate of the soleplate of FIG. 2.

The outlet flow section 15 comprises an outer sidewall 16 and internal walls 17. The internal walls 17 act as baffles to direct the fluid flow through the outlet flow section 15. Fourteen internal walls 17 are shown in FIGS. 5 and 6, although it will be understood that the number and configuration of the internal walls 17 may vary depending on the desired flow path through the outlet flow section 15.

The outer sidewall 16 defines the maximum extent of the outlet flow section 15 and forms a chamber through which fluid from the steam chamber outlet 9 is able to flow. The outer sidewall 16 acts as a baffle to direct the fluid flow through the outlet flow section 15. It will be understood that the configuration of the outer sidewall 16 may also be varied according to the desired flow path through the outlet flow section 15.

The outer sidewall 16 extends from the steam generating plate 5 and partially surrounds the second boundary surface 5B. The internal walls 17 extend from the second boundary surface 5B. The outer and internal walls 16, 17 are integrally formed with the steam generating plate 5, however it will be understood that the configuration may vary. The outer and internal walls 16, 17 extend from the steam generating plate 5 to help maximise heat conduction to the outer and internal walls 16, 17 from the heater 10. This helps to increase the temperature of the outer and internal walls 16, 17 such that liquid water that contacts the outer and internal walls 16, 17 is more quickly evaporated into steam.

The first and second boundary surfaces 4B, 5B and the outer and internal walls 16, 17 form steam contact surfaces of the outlet flow section 15. The heater 10 extends partially around the periphery of outlet flow section 15, proximate to the outer sidewall 16, such that the path of the steam and liquid water from the steam chamber outlet 9 to the steam vents 6 is heated when the heater 10 is operated.

Steam flows from the steam chamber 8 to the outlet flow section 15 via the steam chamber outlet 9. The outer sidewall 16 directs the fluid flow from the steam chamber outlet 9 to the outlet flow section 15. The outer sidewall 16 is generally U-shaped and the steam chamber outlet 9 is proximate the apex of the outer sidewall 16.

The flow path defined in the outlet flow section 15 is shown by Arrows 'B' in FIG. 6 and is a convoluted or indirect flow path. That is, fluid flowing along the flow path B must change direction at least once as it passes along the flow path B. This helps cause a collision of fluid flowing along the flow path B with one or more of the outer and internal walls 16, 17. The flow path B defined in the outlet flow section 15 has a labyrinth configuration. More specifically, the internal walls 17 are arranged such that the flow path B defined in the outlet flow section 15 has a serpentine arrangement.

The internal walls 17 are arranged into first and second groups 17A, 17B. The outer sidewall 16 comprises first and second surfaces 16A, 16B that face towards each other and are located on opposite sides of the longitudinal axis A-A of the soleplate 3.

The internal walls 17 of the first group 17A extend from the first surface 16A of the outer sidewall 16 and each extend towards, but are spaced from, the second surface 16B of the outer sidewall 16 in a direction perpendicular to the longitudinal axis A-A. The internal walls 17 of the second group 17B extend from the second surface 16B of the outer sidewall 16 and each extend towards, but are spaced from, the first surface 16A of the outer sidewall 16 in a direction perpendicular to the longitudinal axis A-A. The internal walls 17 are parallel to each other.

The internal walls 17 of the first group 17A are interspaced by the internal walls 17 of the second group 17B such that the internal walls 17 of the first and second groups 17A, 17B alternate sequentially in the direction of the longitudinal axis A-A of the soleplate 3. The internal walls 17 of the first and second groups 17A, 17B overlap in a direction perpendicular to the longitudinal axis A-A of the soleplate 3 such that there is no line-of-sight through the outlet flow section 15 in the direction of the longitudinal axis A-A. Thus, the outlet flow section 15 comprises a channel that takes an indirect path from the steam chamber outlet 9 to the steam vents 6.

Since the flow path B of the outlet flow section 15 comprises a serpentine configuration, the fluid flowing along the flow path B from the steam chamber outlet 9 must make multiple changes in direction as it flows to the steam vents 6. This helps cause multiple collisions of the fluid flowing along the flow path B with the outer and internal walls 16, 17. The internal walls 17 act as baffles, and direct the flow of fluid through the outlet flow section 15.

The steam vents 6 are located on the other side of the outer sidewall 16 to the steam chamber outlet 9 such that fluid exiting the steam chamber 8 must flow in an indirect path through the labyrinth arrangement of the outlet flow section 15 to reach the steam vents 6. Since the steam and liquid water exiting the steam chamber outlet 9 must flow in an indirect path, the time taken for the steam and liquid water to travel from the steam chamber outlet 9 to the steam vents 6 is increased in comparison to if the steam and liquid water were able to follow a direct linear path. Therefore, if liquid water that is supplied to the steam generating surface 5A accumulates in the steam chamber 8 and flows out of the steam chamber outlet 9 and into the outlet flow section 15, the liquid water will have to take a longer path to reach the steam vents 6 than if the liquid water was able to follow a direct linear path to the steam vents 6. It has been found that making the flow path B more convoluted increases the time it takes for the liquid water to travel from the steam chamber outlet 9 to the steam vents 6.

The heater 10 is configured to heat the outlet flow section 15 such that liquid water that is not evaporated in the steam chamber 8 and subsequently flows into the outlet flow section 15 is evaporated into steam, thereby preventing liquid water from accumulating in the outlet flow section 15 and subsequently being ejected from the steam vents 6. Therefore, the steam iron 1 is able to generate more steam than a conventional steam iron that has a similarly sized steam generating surface 5A but does not include an indirect flow path B between the steam chamber outlet 9 and the steam vents 6. More specifically, the liquid water in the outlet flow section 15 is subjected to the heat from the heater 10 for a longer period of time and so more of the liquid water in the outlet flow section 15 is evaporated into steam than if the liquid water was able to flow directly from the steam chamber outlet 9 to the steam vents 6. Thus, the water supply unit 11 can be operated to supply liquid water to the steam chamber 8 at a high flow rate, to generate a large volume of steam, without the surface area of the steam generating surface 5A having to be increased. This is because it is not necessary to prevent liquid water accumulating in the steam chamber 8 of the steam iron 1, since if the liquid water flows out of steam chamber outlet 9 then it will be evaporated into steam in the outlet flow section 15 due to the fact that the liquid water must follow an indirect flow path to the steam vents 6 and is thus subjected to the heat from the heater 10 for a longer period of time such that more of the liquid water is evaporated into steam. Therefore, the steam iron 1 is suitable for generating a higher flow rate of steam than a known steam iron having a similarly sized steam generating surface but without an indirect flow path between the steam chamber outlet and the steam vents.

In addition, since the outlet flow section 15 is heated by the heater 10, the steam in the outlet flow section 15 is prevented from condensing into liquid water, which would otherwise reduce the efficiency of the steam iron 1.

The arrangement of the outlet flow section 15 may vary. The outlet flow section 15 causes multiple changes in direction to fluid flowing along the flow path B. By providing an indirect fluid flow path B, the direction of flow of fluid passing along the outlet flow section 15 is forced to deviate. Heavier water droplets in the fluid are more resistant to deviations in flow direction and therefore impinge against the outer and internal walls 16, 17 of the outlet flow section 15 and are dispersed as smaller water droplets. These smaller water droplets may be more easily evaporated. Water droplets in contact with a surface of the outer or internal walls 16, 17 of the outlet flow section 15 may be evaporated by the heat of the heater 10 that is conducted to the outer and internal walls 16, 17.

The outlet flow section 15 comprises a porous layer to absorb liquid water in the outlet flow section 15. More specifically, the fabric treating plate 4 and the steam generating plate 5 each comprises a porous layer (not shown) and a non-porous layer (not shown). The non-porous layer of the fabric treating plate 4 comprises the fabric treating face 4A and the porous layer of the fabric treating plate 4 comprises the first boundary surface 4B. The non-porous layer of the steam generating plate 5 comprises the steam generating surface 5A and the porous layer of the steam generating plate 5 comprises the second boundary surface 5B. The porous layers of the fabric treating plate 4 and steam generating plate 5 are configured to absorb liquid water in the outlet flow section 15 to slow the flow of liquid water such that the liquid water takes longer to travel through the outlet flow section 15 from the steam chamber outlet 9 to the steam vents 6. Therefore, liquid water in the outlet flow section 15 is subjected to the heat from the heater 10 for a longer period of time and therefore more of the liquid water is evaporated into steam than if the porous layers were not included. Furthermore, the porous layers increase the surface area of the first and second boundary surfaces 4B, 5B and so increase the heat transfer from the first and second boundary surfaces 4B, 5B, which are heated by the heater 10, to the liquid water in the outlet flow section 15.

It has been found that increasing the thickness of the porous layers of the fabric treating plate 4 and steam generating plate 5 increases the rate at which liquid water in the outlet flow section 15 that can be evaporated into steam. This is because increasing the thickness of the porous layers increases the amount of liquid water in the outlet flow section 15 that can be absorbed by the porous layers and also increases the surface area of the first and second boundary surfaces 4B, 5B. Preferably, the thickness of the porous layers is less than 0.2 mm, and the thickness of the porous layers is 0.1 mm. However, it will be recognised that other thicknesses of the porous layers are possible. In another configuration, one or both of the porous layers are omitted.

The first and second boundary surfaces 4B, 5B and the outer and internal walls 16, 17 of the outlet flow section 15 comprise a coating (not shown) that promotes steam generation. The coating is, for instance, a colloidal steam promoter, such as LUDOX™. The coating causes the liquid water to spread out on the first and second boundary surfaces 4B, 5B such that the liquid water is evaporated into steam more efficiently. Additionally, or alternatively, the coating acts as an insulator to prevent the liquid water being heated too quickly by heater 10 and therefore the Leidenfrost effect is alleviated, which otherwise causes a layer of vapour to form between the liquid water and the first and second boundary surfaces 4B, 5B which prevents the liquid water from directly contacting the first and second boundary surfaces 4B, 5B and thus prevents effective evaporation of the liquid water into steam. Therefore, the coating is configured to increase the evaporation rate of liquid water in the outlet flow section 15 into steam. The coating may be porous and may form the porous layers of the fabric treating plate 4 and steam generating plate 5. Alternatively, the coating may be applied to the surface of the porous layers.

The coating may be applied by spraying the coating onto the first and second boundary surfaces 4B, 5B and the surfaces of the outer and internal walls 16, 17 prior to assembly of the so leplate 3. Alternatively, the coating may be applied by first assembling the soleplate 3 and then evaporating the coating and passing it through the outlet flow section 15 such that the coating is deposited on the first and second boundary surfaces 4B, 5B and the surfaces of the outer and internal walls 16, 17 and then dries thereto.

Figure 7:
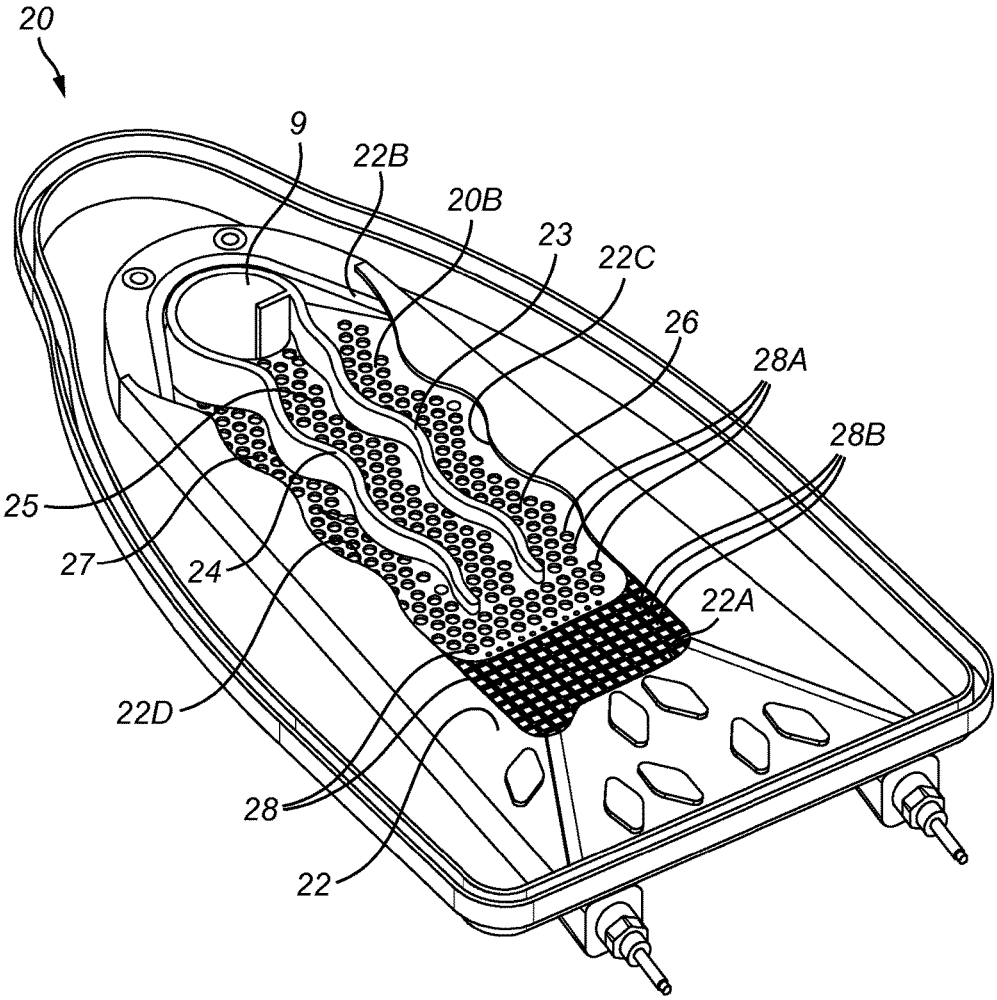
FIG. 7 is a perspective view from underneath of a steam generating plate of a steam iron according to an embodiment of the invention; and, FIG. 8 is a bottom view of the steam generating plate of FIG. 7.
Figure 8:
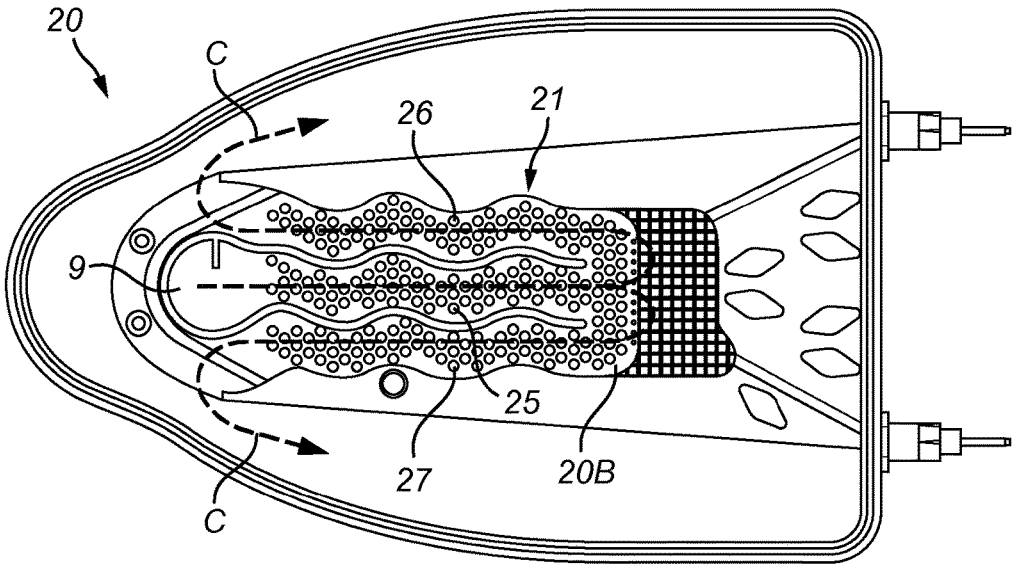

Referring to FIGS. 7 and 8, a steam generating plate 20 of a soleplate of a steam device 1 according to an embodiment of the invention is shown. The steam device is in the form of a steam iron 1 that has a number of the same features as the steam iron 1 described above in relation to FIGS. 1 to 6, with such features retaining the same reference numerals. A difference is that the steam generating plate 5 of the steam iron 1 described above in relation to FIGS. 1 to 6 is omitted and is replaced by an alternative steam generating plate 20.

The steam generating plate 20 is shown in FIGS. 7 and 8 and comprises a steam generating surface (not shown) that is parallel to the fabric treating face of the soleplate and faces in the opposite direction thereto.

An outlet flow section 21 is located between the fabric treating plate and the steam generating plate 20. The outlet flow section 21 fluidly communicates the steam chamber outlet 9 with the steam vents (not shown) and is configured such that fluid flows in an indirect path from the steam chamber outlet 9 to the steam vents. Therefore, the time taken for steam and liquid water to flow from the steam chamber outlet 9 to the steam vents is increased in comparison to if the steam and liquid water were able to follow a direct linear path.

The fabric treating plate comprises a major surface that faces in the opposite direction to the fabric treating face and forms a first boundary surface (not shown) of the outlet flow section 21. The steam generating plate 20 comprises a major surface that faces in the opposite direction to the steam generating surface and forms a second boundary surface 20B of the outlet flow section 21. The first and second boundary surfaces 20B are parallel and face towards each other.

The outlet flow section 21 comprises an outer sidewall 22 and first and second internal walls 23, 24. The first and second internal walls 23, 24 act as baffles to direct the fluid flow through the outlet flow section 21. It will be understood that the number and configuration of the first and second internal walls 23, 24 may vary dependent on the desired flow path through the outlet flow section 21.

The outer sidewall 22 defines the maximum extent of the outlet flow section 21 and forms a chamber through which fluid from the steam chamber is able to flow to the steam vents. The outer sidewall 22 acts as a baffle to direct the fluid flow through the outlet flow section 21. It will be understood that the configuration of the outer sidewall 22 may also be varied according to the desired flow path through the outlet flow section 21.

The outer sidewall 22 extends from the steam generating plate 20 and partially surrounds the second boundary surface 20B. The outer sidewall 22 is generally U-shaped, having a closed end 22A and an open end 22B that is fluidly communicated with the steam vents. The outer sidewall 22 comprises first and second surfaces 22C, 22D that face towards each other and extend between the closed and open ends 22A, 22B of the outer sidewall 22. The outer sidewall 22 and the first and second internal walls 23, 24 extend from the steam generating plate 20 and are integrally formed therewith, however it will be understood that the configuration may vary.

The first and second internal walls 23, 24 extend from opposite sides of the steam chamber outlet 9 and extend towards, but are spaced from, the closed end 22A of the outer sidewall 22 in the direction of the longitudinal axis A-A of the soleplate. The first and second internal walls 23, 24 are disposed on opposite sides of the longitudinal axis A-A of the soleplate.

A first channel 25 is formed between the first and second internal walls 23, 24. A second channel 26 is formed between the first internal wall 23 and the first surface 22C of the outer sidewall 22. A third channel 27 is formed between the second internal wall 24 and the second surface 22D of the outer sidewall 22. The second and third channels 26, 27 are disposed on opposite sides of the longitudinal axis A-A of the soleplate and the first channel 25 is disposed between the second and third channels 26, 27. The first, second and third channels 25, 26, 27 each extend generally parallel to the longitudinal axis A-A of the soleplate.

The first channel 25 fluidly communicates the steam chamber outlet 9 with the closed end 22A of the outer sidewall 22. The second and third channels 26, 27 each fluidly communicate the closed and open ends 22A, 22B of the outer sidewall 22. The open end 22B of the outer sidewall 22 is fluidly communicated with the steam vents.

The steam chamber outlet 9 is configured such that fluid exiting the steam chamber outlet 9 must flow through the outlet flow section 21 before reaching the steam vents. Therefore, steam and liquid water that exits the steam chamber outlet 9 flows along the first channel 25 towards the closed end 22A of the outer sidewall 22 and then changes direction and flows through either the second or third channel 26, 27 to reach the open end 22B of the outer sidewall 22 to pass through the steam vents. Thus, path of the fluid flowing in the outlet flow section 21 splits when the fluid reaches the closed end 22A of the outer sidewall 22 and flows through either of the second and third channels 26, 27.

The flow path defined in the outlet flow section 21 is shown by Arrows 'C' in FIG. 8 and is a convoluted or indirect flow path. That is, fluid flowing along the flow path C must change direction at least once as it passes along the flow path C, since the first and second internal walls 23, 24 form a labyrinth configuration. This helps cause a collision of fluid flowing along the flow path C with one or more of the outer sidewall 22 and the first and second internal walls 23, 24.

Since the steam and liquid water exiting the steam chamber outlet 9 must flow in an indirect path to reach the steam vents, the time taken for the steam and liquid water to travel from the steam chamber outlet 9 to the steam vents is increased in comparison to if the steam and liquid water were able to follow a direct linear path. Therefore, if the liquid water that is supplied to the steam generating surface accumulates in the steam chamber and flows out of the steam chamber outlet 9 and into the outlet flow section 21, the liquid water will have to take a longer path to reach the steam vents than if the liquid water was able to follow a direct linear path to the steam vents.

The first and second boundary surfaces 20B, the outer sidewall 22 and first and second internal walls 23, 24 form steam contact surfaces of the outlet flow section 21. The heater (not shown) extends partially around the periphery of outlet flow section 21 such that flow path C is heated when the heater is operated. The heater is configured to heat the outlet flow section 21 such that liquid water that is not evaporated in the steam chamber and subsequently flows into the outlet flow section 21 is evaporated into steam, thereby preventing liquid water from accumulating in the outlet flow section 21 and subsequently being ejected from the steam vents.

The first, second and third channels 25, 26, 27 each extend in an undulating or wavy path to induce a direction change in the fluid travelling in the outlet flow section 21 such that the relatively heavy larger water droplets hit the outer sidewall 22 and the first and second internal walls 23, 34. This helps cause multiple collisions of the fluid flowing along the flow path C with surfaces of the outlet flow section 21 to remove larger drops of liquid water from the steam.

The steam iron is able to generate more steam than a conventional steam iron that has a similarly sized steam generating surface but does not include an indirect flow path C between the steam chamber outlet 9 and the steam vents. This is because liquid water that flows into the outlet flow section 21 is subjected to the heat from the heater for a longer period of time and so more of the liquid water in the outlet flow section 21 is evaporated into steam than if the liquid water was able to flow directly from the steam chamber outlet 9 to the steam vents. Thus, the water supply unit can be operated to supply liquid water to the steam chamber at a high flow rate, to generate a large volume of steam, without the size of the steam generating plate 20 having to be increased. Therefore, the steam iron of the present embodiment of the invention is suitable for generating a higher flow rate of steam than a known steam iron having a similarly sized steam generating plate but without an indirect flow path between the steam chamber outlet and the steam vents. In addition, since the outlet flow section 21 is heated by the heater, steam in the outlet flow section 21 is prevented from condensing into liquid water, which would otherwise reduce the efficiency of the steam iron.

Similarly to the outlet flow section 15 of the steam iron 1 described above in relation to FIGS. 1 to 6, the outlet flow section 21 of the embodiment shown in FIGS. 7 and 8 comprises a porous layer to absorb liquid water in the outlet flow section 21. More specifically, the fabric treating plate and/or the steam generating plate 20 comprises a porous layer that is configured to absorb liquid water in the outlet flow section 21 to slow the flow of liquid water such that the liquid water takes longer to travel through the outlet flow section 21 from the steam chamber outlet 9 to the steam vents. Therefore, liquid water in the outlet flow section 21 is subjected to the heat from the heater for a longer period of time and therefore more of the liquid water is evaporated into steam than if the porous layers were not included. Furthermore, the porous layers increase the surface area of the first and second boundary surfaces 20B and so increase the heat transfer from the first and second boundary surfaces 20B, which are heated by the heater, to the liquid water in the outlet flow section 21. In an alternative embodiment, the outlet flow section 21 does not comprise a porous layer.

The outlet flow section 21 comprises a plurality of formations 28. The plurality of formations 28 are in the form of a plurality of recesses 28A in the first and second boundary surfaces 20B and a plurality of protrusions 28B that extend from the first and second boundary surfaces 20B. Liquid water in the outlet flow section 21 flows into the recesses 28A such that the flow rate of the liquid water through the outlet flow section 21 is reduced such that more of the liquid water in the outlet flow section 21 is evaporated into steam before it reaches the steam vents. In addition, the recesses 28A increase the surface area of the first and second boundary surfaces 20B and therefore increase the heat transfer between the first and second boundary surfaces 20B and the liquid water such that the evaporation rate of the liquid water is increased. In addition, liquid water in the outlet flow section 21 flows around the protrusions 28B such that the flow rate of the liquid water is reduced such that more of the liquid water in the outlet flow section 21 is evaporated into steam before it reaches the steam vents. In addition, the protrusions 28B increase the surface area of the first and second boundary surfaces 20B such that the heat transfer between the first and second boundary surfaces 20B and the liquid water is increased. In alternate embodiments (not shown), the recesses 28A on one of the first and second boundary surfaces 20B and/or the protrusions 28B on one or both of the first and second boundary surfaces 20B are omitted. It should be recognised that the outlet flow section 15 of the steam iron 1 described above in relation to FIGS. 1 to 6 may also comprise a plurality of formations to increase the evaporation rate of liquid water in the outlet flow section 15.

Similarly to the outlet flow section 15 of the steam iron 1 described above in relation to FIGS. 1 to 6, the outlet flow section 21 of the embodiment shown in FIGS. 7 and 8 comprises a coating (not shown) that promotes steam generation. More specifically, one or more of the first and second boundary surfaces 20B, the outer sidewall 22 and the first and second internal walls 23, 24 of the outlet flow section 21 comprise a coating (not shown) that promotes steam generation. The coating is a steam promoter, and may be a colloidal silica steam promoter, such as LUDOX™. The coating causes the liquid water to spread out on the first and second boundary surfaces 20B such that the liquid water is evaporated into steam more efficiently. Additionally, or alternatively, the coating acts as an insulator to prevent the liquid water being heated too quickly by heater and therefore alleviates the Leidenfrost effect. Therefore, the coating is configured to increase the evaporation rate of liquid water in the outlet flow section 21 into steam.

In the above described embodiments, the height H (shown in FIG. 6) of the outlet flow section 15, 21, which is the distance between the first boundary surface 4B and the second boundary surface 5B, 20B is 5 mm or less, and preferably 3 mm or less, to encourage liquid water in the outlet flow section 15, 21 to contact both the first boundary surface 4B and the second boundary surface 5B, 20B. This causes the liquid water in the outlet flow section 15, 21 to be heated by both the first boundary surface 4B and the second boundary surface 5B, 20B simultaneously to increase the rate at which the liquid water is evaporated into steam. In the above described embodiments, the height H of the outlet flow section 15, 21 is 3 mm.

Although in the above described embodiments the coating comprises LUDOX™, in alternate embodiments the coating may comprise another component such as silicates, phosphates, borates or XYLAN™.

In the above described embodiments, the steam device 1 is in the form of a steam iron 1. However, it should be recognised that the invention is suitable for use with other types of seam device. For example, in one alternative embodiment (not shown) the steam device is in the form of a steamer head for a fabric steamer that is suitable for removing creases from a vertically hung fabric.

In the above described embodiments, the water tank 12 is disposed within the housing 2 of the steam iron 1. However, in an alternative embodiment (not shown), the water tank 12 is disposed in a separate stand or base unit and the liquid water is supplied from the base unit to the steam generating surface 4A via a hose. The pump 13 may be disposed in the housing 2 of the steam iron 1 or in the base unit.

It will be appreciated that the term "comprising" does not exclude other elements or steps and that the indefinite article "a" or "an" does not exclude a plurality. A single processor may fulfil the functions of several items recited in the claims. The mere fact that certain measures are recited in mutually different dependent claims does not indicate that a combination of these measures cannot be used to an advantage. Any reference signs in the claims should not be construed as limiting the scope of the claims.

Although claims have been formulated in this application to particular combinations of features, it should be understood that the scope of the disclosure of the present invention also includes any novel features or any novel combinations of features disclosed herein either explicitly or implicitly or any generalisation thereof, whether or not it relates to the same invention as presently claimed in any claim and whether or not it mitigates any or all of the same technical problems as does the parent invention. The applicants hereby give notice that new claims may be formulated to such features and/or combinations of features during the prosecution of the present application or of any further application derived therefrom.

The invention claimed is:

1. A steam device comprising:

a steam chambers a steam generating plate comprising:

a steam generating surface onto which liquid water is provided to be evaporated into steam;

a fabric treating plate comprising a fabric treating face and at least one steam vent through which steam is expelled onto a fabric;

an outlet flow section located between the steam generating surface and the fabric treating face wherein the fabric treating plate and steam generating plate each form a boundary surface of the outlet flow section and the outlet flow section further comprising a plurality of internal walls on at least one of the boundary surfaces, said internal walls forming an indirect flow path between the steam chamber and the at least one steam vent; and a heater for heating the outlet flow section such that liquid water which enters the outlet flow section from the steam chamber is evaporated into steam.

2. The steam device according to claim 1, wherein the internal walls are configured to form said indirect flow path into a labyrinth.

3. The steam device according to claim 2, wherein the internal walls are configured to form the indirect flow path into a serpentine channel.

4. The steam device according to claim 1, wherein the indirect flow path (C) comprises at least one baffle configured to change a direction of fluid flowing in the outlet flow section.

5. The steam device according to claim 4, wherein the at least one baffle extends from the steam generating plate.

6. The steam device according to claim 1, wherein the internal walls comprise a first portion that extend in a first direction and a second portion that extend in a second direction, opposite to the first direction.

7. The steam device according to claim 1, wherein the internal walls are wavy.

8. The steam device according to claim 1, wherein the heater is configured to:

heat the steam generating surface to maintain the steam generating surface and the outlet flow section at a temperature of at least 100 degrees Celsius.

9. The steam device according to claim 1, wherein the outlet flow section comprises a coating configured to:

promote the evaporation of liquid water into steam in the outlet flow section.

10. The steam device according to claim 9, wherein the coating is a colloidal steam promoter.

11. The steam device according to claim 1, wherein the outlet flow section comprises a porous layer configured to:

absorb liquid water in the outlet flow section.

12. The steam device according to claim 1, wherein at least one boundary surface of the outlet flow section comprises a plurality of protrusions.

13. The steam device according to claim 1, wherein the height of the outlet flow section, in the direction between the fabric treating face and the steam generating surface, is no greater than 5 mm.

14. A steam device according to claim 1, wherein the steam device is in the form of a steam iron.

15. The steam device according to claim 13, wherein the height of the outlet flow section, in the direction between the fabric treating face and the steam generating surface is no greater than 3 mm.

* * * * *